US007451705B2

(12) United States Patent
Fry

(10) Patent No.: US 7,451,705 B2
(45) Date of Patent: Nov. 18, 2008

(54) NON-DISCARDING SABOT PROJECTILE SYSTEM

(76) Inventor: Grant R. Fry, 21620 Graybill St., Chugiak, AK (US) 99567

( * ) Notice: Subject to any disclaimer, the term of this patent is extended or adjusted under 35 U.S.C. 154(b) by 572 days.

(21) Appl. No.: 11/079,053

(22) Filed: Mar. 14, 2005

(65) Prior Publication Data

US 2006/0011091 A1 Jan. 19, 2006

Related U.S. Application Data

(60) Provisional application No. 60/554,101, filed on Mar. 17, 2004.

(51) Int. Cl.
*F42B 14/06* (2006.01)

(52) U.S. Cl. ..... 102/520; 102/515

(58) Field of Classification Search ..... 102/514–516, 102/520–523, 530, 531
See application file for complete search history.

(56) References Cited

U.S. PATENT DOCUMENTS 733,920 A * 7/1903 Scott ..... 102/514
3,143,966 A * 8/1964 Burns, Jr. et al. ..... 102/507
4,503,777 A * 3/1985 Young ..... 102/514
4,878,434 A * 11/1989 Sommet ..... 102/514
4,939,997 A * 7/1990 Hoffman ..... 102/503
5,488,909 A * 2/1996 Moser ..... 102/529
5,794,320 A * 8/1998 Wernz et al. ..... 86/55
6,186,071 B1 * 2/2001 Fry ..... 102/515
6,305,293 B1 * 10/2001 Fry et al. ..... 102/517

* cited by examiner

*Primary Examiner*—Bret Hayes
(74) *Attorney, Agent, or Firm*—Kirton & McConkie; Michael F. Krieger

(57) ABSTRACT

This present invention relates to a non-discarding sabot projectile system. One embodiment of the present invention relates to coupling the sabot to the core at one or both of an upper sidewall region and a bottom region. The upper sidewall coupling between the sabot and the core utilizes a keyed groove system in which the sabot is hooked into a recess on the core. The bottom coupling between the sabot and the core utilizes a lower member that extends below the core and through the sabot. The lower member is configured to be punched to expand into the sabot. In addition, a cup member is disposed on the sabot below the core. The cup member scrapes carbon material off of the inside of the gun barrel as the system is loaded. In addition, the cup member minimizes fouling and improves accuracy by providing an additional seal between the sabot and the barrel during operation.

2 Claims, 2 Drawing Sheets

NON-DISCARDING SABOT PROJECTILE SYSTEM

RELATED APPLICATIONS

This application claims priority to U.S. provisional application Ser. No. 60/554,101, filed Mar. 17, 2004.

BACKGROUND

1. Field of the Invention

This present invention relates to non-discarding sabot projectile systems and in particular, a system for utilizing a wide variety of cores in a non-discarding projectile application.

2. Background of the Invention and Related Art

Guns, such as hand guns and rifles, are designed to interact with a cartridge for discharging a projectile, commonly referred to as a bullet. A cartridge includes a metal case which houses a charge such as gun powder. Mounted at one end of the case is a primer. The projectile is crimped or otherwise secured to the opposing end of the case.

During operation, the cartridge is positioned within the chamber of a gun. By depressing a trigger, a hammer strikes against the primer. In turn, the primer ignites the gun powder which burns at an extremely fast and almost instantaneous rate. As the gunpowder burns, it produces a gas. The rapid expansion of the gas detaches the projectile from the case and pushes the projectile down and out the end of the barrel.

It has long been known that imparting an axial rotation to the projectile significantly improves the accuracy in which the projectile can be fired. Several approaches have been used to impart rotation to the projectile. The most common approach is to form a series of spiral grooves that longitudinally extend along the interior surface of the barrel. The projectile is configured to engage the grooves and thus rotate as the projectile travels the length of the barrel. Momentum allows the projectile to continue to spin after the projectile leaves the barrel.

Depending on the type of projectile used, different approaches have been used to engage the projectile and the grooves. For example, some projectiles are made from relatively soft lead alloys. During discharge, the force of the expanding gas causes the projectile to obterate and radially expand, thereby engaging the grooves. Where the projectile is made of a harder material, the projectile is configured having a diameter slightly larger than the inner diameter of the barrel. As a result, the projectile is forced into the grooves as the projectile travels within the barrel.

Although the operation of guns has become a refined science, there are still several shortcomings associated with conventional projectiles. For example, extended firing of a gun, such as commonly encountered in the military, results in pressure from the expanding gases wearing or deteriorating the interior surface of the gun barrel. Significant wear on the barrel occurs much earlier when hard projectiles are used. The resulting wear on the barrel can produce irregular flight paths in the projectile and can reduce the speed and distance which the projectile travels. In such cases, it is necessary to replace the gun or at least the barrel thereof.

The problem with using lead alloy bullets is that they produce lead build-up on the interior surface of the barrel. Lead build-up increases the resistance on the projectile and can radically increase pressures as well as offset the flight path of the projectile. One approach to solving this problem has been to use various cleaning materials to remove the lead build-up from the interior surface of the barrel. This cleaning process, however, requires the use of toxic solvents that produce a harmful lead waste.

Discarding sabots have been used as another approach to overcoming some of the above problems. A discarding sabot is simply a plastic jacket that is placed over the projectile. During firing, the expanding gas results in expansion of the projectile and sabot such that the sabot, rather than the projectile, engages the grooves of the barrel. By engaging the grooves, the sabot rotates which in turn imparts a rotational movement to the projectile. As the projectile exits the barrel, the sabot is caught by the surrounding air and peeled off of the projectile, allowing the projectile to freely travel. The discarding sabot thus eliminates and prevents the need for the metal projectile to engage the interior surface of the barrel. As a result, wear on the barrel is minimized. Furthermore, there is no metal fouling or buildup in the barrel.

Although sabots produce some advantages, conventional discarding sabots also produce significant problems. For example, as a discarding sabot leaves the barrel, it rapidly expands to release the projectile. In some instances, the sabot breaks apart resulting in a fouled bore. The discarding sabot can produce bore fouling. Specifically, the discarding sabot can clog or otherwise obstruct such systems as sound suppressors, flash suppressors, gas recoil systems, recoil reduction systems, and bore evacuators. Furthermore, if the sabot does not evenly release the projectile, the projectile can become imbalanced and subsequently tumble.

SUMMARY AND OBJECTS OF THE INVENTION

This present invention relates to a non-discarding sabot projectile system. One embodiment of the present invention relates to coupling the sabot to the core at one or both of an upper sidewall region and a bottom region. The upper sidewall coupling between the sabot and the core utilizes a keyed groove system in which the sabot is hooked into a recess on the core. The bottom coupling between the sabot and the core utilizes a lower member that extends below the core and through the sabot. The lower member is configured to be punched to expand into the sabot. In addition, a cup member is disposed on the sabot below the core. The cup member scrapes carbon material off of the inside of the gun barrel as the system is loaded. In addition, the cup member minimizes fouling and improves accuracy by providing an additional seal between the sabot and the barrel during operation.

These and other features and advantages of the present invention will be set forth or will become more fully apparent in the description that follows and in the appended claims. The features and advantages may be realized and obtained by means of the instruments and combinations particularly pointed out in the appended claims. Furthermore, the features and advantages of the invention may be learned by the practice of the invention or will be obvious from the description, as set forth hereinafter.

BRIEF DESCRIPTION OF THE DRAWINGS

In order that the manner in which the above recited and other features and advantages of the present invention are obtained, a more particular description of the invention will be rendered by reference to specific embodiments thereof, which are illustrated in the appended drawings. Understanding that the drawings depict only typical embodiments of the present invention and are not, therefore, to be considered as limiting the scope of the invention, the present invention will be described and explained with additional specificity and detail through the use of the accompanying drawings in which.

DETAILED DESCRIPTION OF THE PREFERRED EMBODIMENTS

It will be readily understood that the components of the present invention, as generally described and illustrated in the figures herein, could be arranged and designed in a wide variety of different configurations. Thus, the following more detailed description of the embodiments of the system and method of the present invention is not intended to limit the scope of the invention, as claimed, but is merely representative of the presently preferred embodiments of the invention.

This present invention relates to a non-discarding sabot projectile system. One embodiment of the present invention relates to coupling the sabot to the core at one or both of an upper sidewall region and a bottom region. The upper sidewall coupling between the sabot and the core utilizes a keyed groove system in which the sabot is hooked into a recess on the core. The bottom coupling between the sabot and the core utilizes a lower member that extends below the core and through the sabot. The lower member is configured to be punched to expand into the sabot. In addition, a cup member is disposed on the sabot below the core. The cup member scrapes carbon material off of the inside of the gun barrel as the system is loaded. In addition, the cup member minimizes fouling and improves accuracy by providing an additional seal between the sabot and the barrel during operation. While embodiments of the present invention are directed at non-discarding sabot projectile systems, it will be appreciated that the teachings of the present invention are applicable to other areas.

Figure 1:
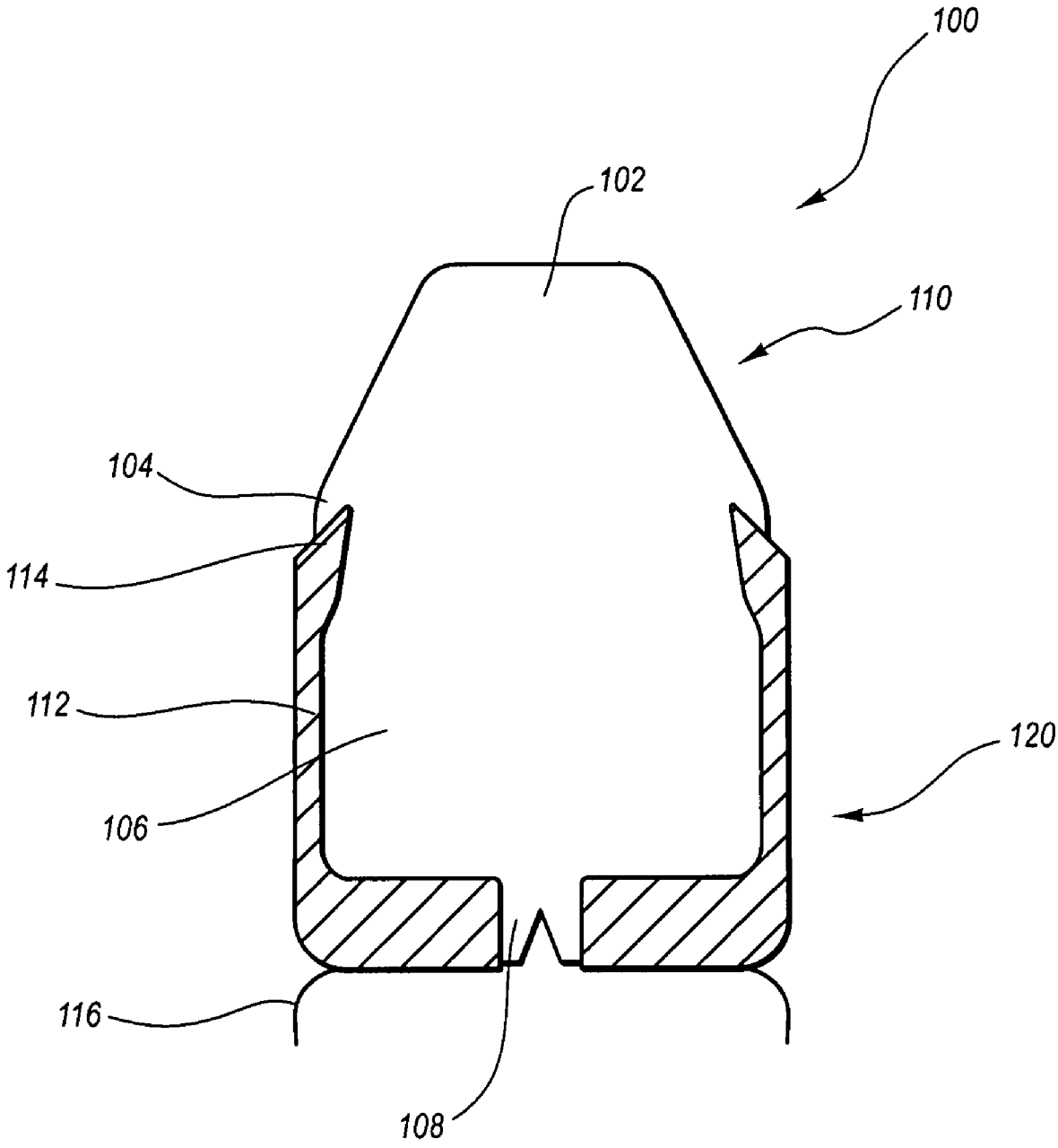
FIG. 1 is a bisected view of a non-discarding sabot projectile system including a core and a sabot in accordance with one embodiment of the present invention.
Figure 2:
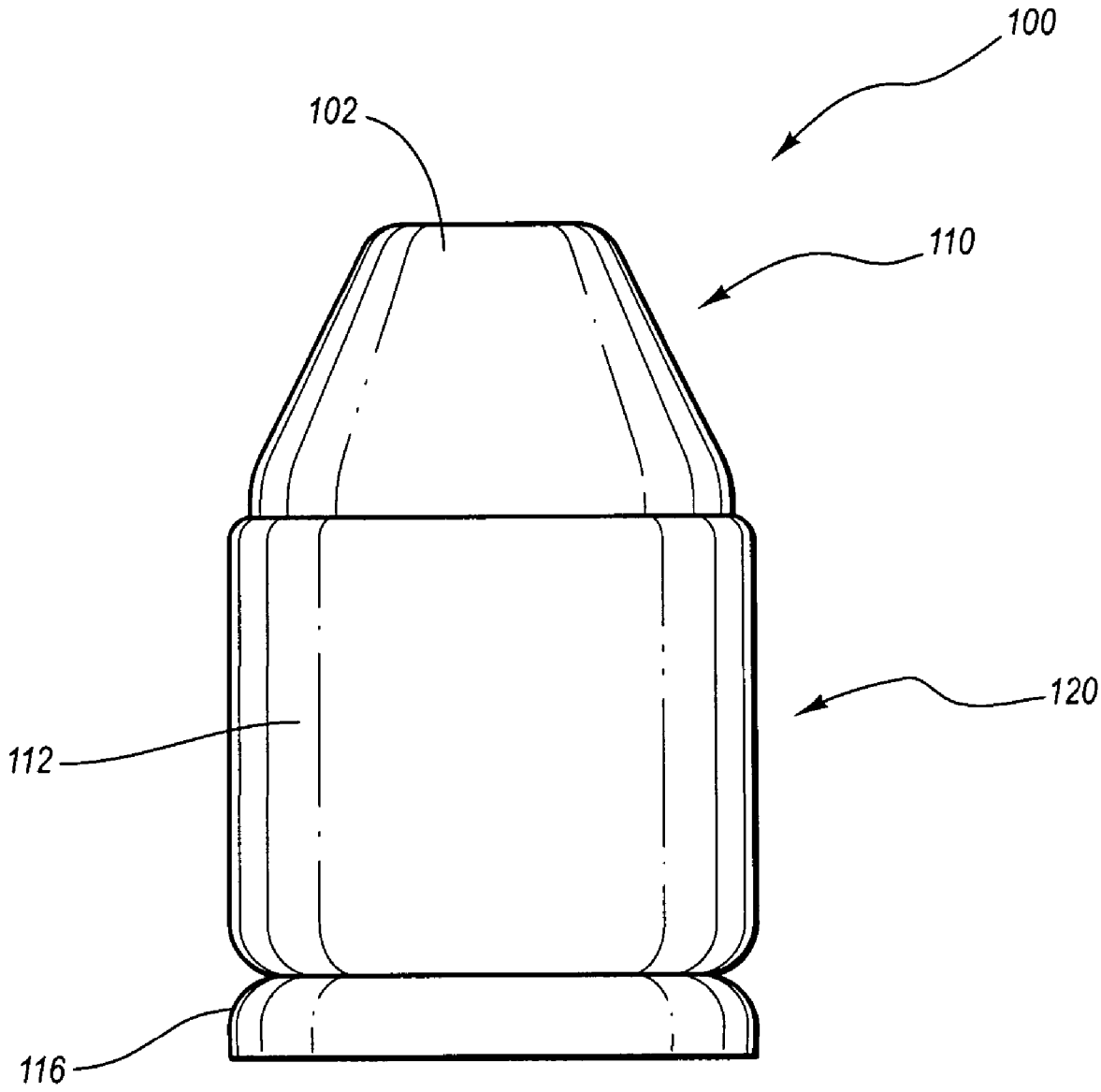
FIG. 2 is a profile view of the non-discarding sabot projectile system illustrated in FIG. 1.

Reference is initially made to FIGS. 1 and 2, which illustrate a bisected and a profile view of a non-discarding sabot projectile system including a core and a sabot in accordance with one embodiment of the present invention. The system is designated generally at 100. The system generally includes a core 110 and a sabot 120. The system is designed for use with a black powder/muzzle-loading firearm system in which the system is manually loaded into the barrel before firing.

The core 110 further includes a head 102, a lateral coupling system 104, a body 106, and a lower member 108. The head 102 is shaped in a partial conical manner to increase accuracy and minimize wind resistance during propulsion. Various aerodynamic properties may be applied to the head 102 to further adjust its shape in accordance with this invention. The lateral coupling system 104 is a circumferential recess that extends around the outside of the core 110 at approximately the junction between the conical head 102 region and the cylindrical body 106 region. This location minimizes the aerodynamic affects of the lateral coupling system but other lateral coupling system locations may be used and remain consistent with the present invention. As illustrated, the circumferential recess is angularly shaped towards the head 102 region. The body 106, is a substantially cylindrical shaped region that defines the middle portion of the core 110. The lower member 108 is a smaller cylindrical region that extends below the body 106 and is centered with respect to the lower surface of the body 106. The lower member 108 is composed of a bonding material that can be punched or notched to bond with an adjacent object. The illustrated embodiment shows a conical shaped punch in the bottom of the lower member 108 which causes it to bond with the adjacent sabot 120.

The sabot 120 further includes a shell 112, a hook 114, and a cup 116. The shell is shaped to laterally conform to the core 110 such that the sabot 120 can be fitted over the core 110 as shown. The shell is generally composed of a material including but not limited to plastic. The hook 114 is configured to hook into the circumferential recess on the core 110 to create a non-discarding bond between the sabot 120 and the core 110. The hook 114 is angled to minimize resistance and other aerodynamic affects at the coupling region between the hook 114 and the circumferential recess of the core 110. The shell 112 further includes a recess at the bottom which is shaped to allow the lower member 108 of the core 110 to extend through. In addition, the sides of the recess are bonded in a non-discarding manner to the lower member 108 once the lower member is punched. One embodiment of a bonding process will be described below. The cup 116 is a downward facing thin walled cupped region that is located on the outer most portion of the sabot 120. The cup 116 is configured to assist in scraping off carbon deposits at the system 100 is loaded into a barrel. In addition, the cup 116 provides a seal between the system 100 and the barrel during firing to minimize blowing out residue.

In operation, the sabot 120 is coupled to the core 110 by inserting the core 110 into the sabot 120 such that the lower member 108 of the core 110 extends through the sabot 120 and such that the lower member 108 is flush with the bottom surface of the sabot 120 as shown. In addition, the sabot 120 must be properly aligned with the circumferential recess on the core 110 to create a non-discarding bond between the core 110 and the sabot 120. The lower member 108 is then expanded into the sabot 120 thereby creating another non-discarding bond between the core 110 and the sabot 120. As discussed above, the method of expansion can include punching, drilling, pressing, etc. The system 100 can then be loaded by extending the system 100 into the barrel portion of the muzzle loading arm with the cup 116 of the sabot 120 oriented at the back. As the system 100 is extended into the barrel, scraping the carbon from the inside of the barrel with the cup 116. The removal of the internal carbon improves firing accuracy and minimizes undesired environmental firing bursts. The scraped carbon is easily burned up when the system 100 is fired from the barrel. The cup 116 also creates a seal between the system 100 and the barrel minimizing fouling during operation.

Thus, as discussed herein, the embodiments of the present invention relate to non-discarding sabot projectile systems. The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

What is claimed and desired to be secured by Letters Patent is:

1. A non-discarding sabot projectile system comprising:

a metal core having an upper sidewall region and a lower sidewall region, wherein the upper sidewall region has a top and a bottom;

a nonmetallic sabot having a top and bottom, the sabot extending around the upper sidewall region of the core and coupled to the core at both the top of the upper sidewall region and bottom of the upper sidewall region;

said top coupling utilizing a circumferential recess forming a keyed groove and in which a hook formed into the top of the sabot engages the recess in the core thereby providing a non-discarding bond between the sabot and the core; and the lower sidewall region of the core extending beyond a second circumferential groove at the bottom of the upper sidewall region, the bottom of the sabot having a cupped ring which is held in the circumferential recess by friction thereby providing a non-discarding coupling between the core and the top of the sabot and bottom of the sabot.

2. The non-discarding sabot projectile system of claim 1, wherein the lower region of the core is substantially cylindrically shaped.

* * * * *